US009743467B2

(12) United States Patent
Malyna et al.

(10) Patent No.: US 9,743,467 B2
(45) Date of Patent: Aug. 22, 2017

(54) DRIVER DEVICE AND DRIVING METHOD FOR DRIVING A LOAD, IN PARTICULAR A LED UNIT COMPRISING ONE OR MORE LEDS

(71) Applicant: PHILIPS LIGHTING HOLDING B.V., Eindhoven (NL)

(72) Inventors: Dmytro Viktorovych Malyna, Eindhoven (NL); Patrick Alouisius Martina De Bruycker, Nuenen (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/375,180

(22) PCT Filed: Jan. 18, 2013

(86) PCT No.: PCT/IB2013/050468

§ 371 (c)(1),
(2) Date: Jul. 29, 2014

(87) PCT Pub. No.: WO2013/114242

PCT Pub. Date: Aug. 8, 2013

(65) Prior Publication Data

US 2015/0002040 A1 Jan. 1, 2015

Related U.S. Application Data

(60) Provisional application No. 61/593,378, filed on Feb. 1, 2012.

(51) Int. Cl.
*H05B 37/02* (2006.01)
*H05B 33/08* (2006.01)

(52) U.S. Cl.
CPC ..... *H05B 33/0815* (2013.01); *H05B 33/0842* (2013.01); *H05B 33/0887* (2013.01); *H05B 37/02* (2013.01)

(58) Field of Classification Search
CPC .... H05B 33/08; H05B 37/02; H05B 33/0815; H05B 33/0842; H05B 33/0887
(Continued)

(56) References Cited

U.S. PATENT DOCUMENTS 8,154,221 B2 * 4/2012 Godbole ..... H05B 33/0815 315/247
2010/0141178 A1 6/2010 Negrete et al.
(Continued)

FOREIGN PATENT DOCUMENTS

CN 101049047 A 10/2007
CN 101690397 A 3/2010
(Continued)

*Primary Examiner* — Tung X Le
(74) *Attorney, Agent, or Firm* — Akarsh P. Belagodu

(57) ABSTRACT

The present invention relates to a driver device (60) for driving a load (12), in particular an LED unit comprising one or more LEDs, said driver device comprising input terminals (28, 30) for receiving an input voltage (V12) from an external power supply (16), output terminals for providing an output voltage to the load (12) for driving the load (12), a converter unit (34) for converting the input voltage (VI 2) to a converted voltage (VI 4) and for providing the converted voltage (VI 4) to internal connection elements (63, 64) of the driver device (60), a signal control device (62) for applying an electrical signal (I) to at least one of the connection elements (63, 64), and a detection circuit for detecting a phase angle of the input voltage (VI 2) by measuring a voltage drop of the converted voltage (VI 4) caused by the electrical signal (I).

15 Claims, 6 Drawing Sheets

(58) Field of Classification Search
USPC .... 315/200 R, 219, 224, 291, 307, 308, 360
See application file for complete search history.

(56) References Cited

U.S. PATENT DOCUMENTS

| | | | | |
|---|---|---|---|---|
| 2010/0295478 | A1 | 11/2010 | Wei et al. | |
| 2010/0320840 | A1 | 12/2010 | Fridberg | |
| 2011/0194311 | A1* | 8/2011 | Gaknoki | H02M 7/217 363/21.12 |
| 2011/0234115 | A1 | 9/2011 | Shimizu et al. | |
| 2011/0266968 | A1 | 11/2011 | Bordin et al. | |
| 2011/0291592 | A1* | 12/2011 | Anissimov | H05B 33/0815 315/307 |
| 2011/0309759 | A1* | 12/2011 | Shteynberg | H05B 33/0815 315/201 |
| 2013/0169177 | A1* | 7/2013 | Liao | G05F 1/10 315/200 R |

FOREIGN PATENT DOCUMENTS

| | | | |
|---|---|---|---|
| EP | 2257124 | A1 | 12/2010 |
| WO | 2010137002 | A1 | 12/2010 |
| WO | 2011001327 | A1 | 1/2011 |
| WO | 2011008635 | A1 | 1/2011 |
| WO | 2011061633 | A1 | 5/2011 |
| WO | WO2013035045 | A1 | 3/2013 |

* cited by examiner

DRIVER DEVICE AND DRIVING METHOD FOR DRIVING A LOAD, IN PARTICULAR A LED UNIT COMPRISING ONE OR MORE LEDS

CROSS-REFERENCE TO PRIOR APPLICATIONS

This application is the U.S. National Phase application under 35 U.S.C. §371 of International Application No. PCT/IB13/050468, filed on Jan. 18, 2013, which claims the benefit of U.S. Provisional Patent Application No. 61/593,378, filed on Feb. 1, 2012. These applications are hereby incorporated by reference herein.

FIELD OF THE INVENTION

The present invention relates to a driver device and a corresponding method for driving a load, in particular an LED unit comprising one or more LEDs. Further, the present invention relates to a light apparatus.

BACKGROUND OF THE INVENTION

In the field of LED drivers for offline applications such as retrofit lamps and new lamps or modules, solutions are demanded to cope with high efficiency, high power density and high power factor among other relevant features. While practically all existing solutions comprise one or another requirement, it is essential that the proposed driver circuit properly conditions the form of the mains energy into the form required by the LEDs while remaining in compliance with present and future power mains regulations. It is of critical importance to control the amount of power delivered to the lamps to control the brightness of the lamps, while having a high efficiency and reduced power loss in the power converter. To control the amount of power delivered to the lamps, phase cut dimming is one option having a high efficiency and a low power loss. If driver devices are used including a phase cut dimmer, the lamps derive the electrical power from the phase cut mains voltage and have to recover the phase cut position, in order to set the power level of the lamp accordingly. Trailing edge phase cut dimmers, which are preferably used, do not always provide a voltage step with a significant edge, which is easy to detect due to the filter capacitors across the lamp and across the dimmer. Therefore, the lamps are provided with a bleeder circuit having one or more bleeder resistors to drain the charged capacitor, in order to verify that the dimmer is turned off. However, the bleeding current increases the power loss of the lamps.

WO 2010137002 A1 discloses a phase cut dimmer device for driving an LED unit, wherein the LED unit comprises a bleeder circuit to adjust the rectified phase cut input voltage. The bleeder circuits comprise detection means to detect the voltage drop at two predefined voltage levels to activate one of the two bleeder circuits. Detection of the phase angle of the phase cut voltage in an accurate manner is not possible with this bleeder circuit.

SUMMARY OF THE INVENTION

It is an object of the present invention to provide a driver device and a corresponding method for driving a load, in particular an LED unit comprising one or more LEDs, providing a high power factor, reduced losses and low cost.

Further, it is an object of the present invention to provide a corresponding light apparatus.

According to an aspect of the present invention, a driver device for driving a load, in particular an LED unit comprising one or more LEDs, is provided comprising:

- input terminals for receiving an input voltage from an external power supply,
- output terminals for providing an output voltage to the load for driving the load,
- a converter unit for converting the input voltage to a converted voltage and for providing the converted voltage to internal connection elements of the driver device,
- a signal control device for applying an electrical signal to at least one of the connection elements, and
- a detection circuit for detecting a phase angle of the input voltage by measuring a voltage drop of the converted voltage caused by the electrical signal.

According to another aspect of the present invention, a drive method for driving a load, in particular an LED unit comprising one or more LEDs, is provided, said method comprising:

- receiving an input voltage from an external power supply at input terminals,
- converting the input voltage to a converted voltage and providing the converted voltage to internal connection elements,
- applying an electrical signal to at least one of the connection elements by means of a signal control unit, and
- detecting a phase angle of the input voltage by detecting a voltage drop of the converted voltage caused by the electrical signal.

According to still another aspect of the present invention, a light apparatus is provided comprising a light assembly comprising one or more light units, in particular an LED unit comprising one or more LEDs, and a driver device for driving the light assembly as provided according to the present invention.

Preferred embodiments of the invention are defined in the dependent claims. It shall be understood that the claimed method has similar and/or identical preferred embodiments as the claimed device and as defined in the dependent claims.

The present invention is based on the idea to detect whether the input voltage from the external power supply is applied to the input terminal by applying the electrical signal to the internal connection elements. The electrical signal creates a voltage dip in the converted voltage, wherein the dip is limited to a low peak if the input voltage is applied to the input terminal and wherein the peak is large if the input voltage is not provided to the input terminals. Therefore, if a phase cut dimmer device is connected to the external power supply and the input voltage is a phase cut input voltage, a detection circuit can precisely detect the phase angle on the basis of the peak value of the voltage drop or a voltage dip of the converted voltage, and the connected load can be controlled accordingly. Therefore, power consuming bleeding currents can be avoided to detect the phase angle of the input voltage. By virtue thereof, the total losses in the driver device due to bleeding are reduced with low technical effort and low cost.

In an embodiment, the electrical signal is a current drawn from or provided to the input terminal. This is an effective possibility to create a voltage dip in the converted voltage to detect the phase angle of the input voltage.

In an embodiment, the signal control device comprises an electrical storage element for storing electrical energy and a controllable switch for electrically connecting the electrical storage element to at least one of the connection elements. By means of the electrical storage element the electrical signal can be provided to the connection element for a short time frame with low technical effort and low power loss.

In a further embodiment, the signal control device comprises a charge control element connected to the electrical storage element for controlling the electrical charge stored in the electrical storage element. This is an effective and simple solution to provide a defined voltage potential for providing the electrical signal as desired.

According to a further embodiment, the electrical storage element is a charge capacitor. The charge capacitor can provide a defined voltage potential to the connection element and can be charged quickly to create a short voltage drop or dip in the converted voltage with low power loss.

According to an alternative embodiment, the signal control device comprises a current path including a resistor and a controllable switch for connecting the connection elements to each other. By connecting the connection elements to each other, a short bleeding current pulse can be provided to create a voltage dip in the converted voltage with low technical effort.

According to a further alternative embodiment, the signal control device comprises a controllable current source for providing the electrical signal. The advantage of the controllable current source is that the electrical signal can be set precisely to create a predefined voltage dip which can be detected easily.

According to a further embodiment, the converter unit comprises a rectifier unit connected to the input terminals for rectifying the input voltage to a unipolar voltage provided to the connection elements. This is a simple circuitry for deriving a unipolar voltage for driving an LED unit from an alternating bipolar voltage provided by the mains.

According to a preferred embodiment, the detection circuit comprises a differentiator circuit for measuring the voltage drop or dip of the converted voltage. The differentiator circuit is a simple solution for measuring a voltage drop of the converted voltage, since the change of the converted voltage is detected and since the differentiator can be implemented with reduced effort, e.g. in an integrated circuit.

It is preferred that the signal control device is adapted to provide the electrical signal for a time period of less than 1/10 of a half-cycle of the input voltage, in particular less than 200 μs. Since the power loss of the signal control device is dependent on the duration of the electrical signal, the power loss can be reduced by providing the electrical signal for a short time frame of less than 1/10 of the half-cycle of the input voltage.

According to a further preferred embodiment, the input voltage is an alternating phase cut voltage, and wherein the signal control unit is adapted to apply the electrical signal at different points in time within each half cycle of the input voltage to detect the phase angle of the input voltage. This is an effective and simple possibility to detect the phase angle of the phase cut input voltage with low power consumption.

According to an embodiment, the driver device is connected to a dimmer device providing the phase cut input voltage, and wherein the driver device is adapted to receive a trailing edge phase-cut voltage as the input voltage.

According to an embodiment of the driving method, the input voltage is an alternating phase cut voltage and the point in time at which the electrical signal is applied is varied within each half cycle of the input voltage to detect the phase angle of the input voltage. This is an effective solution to detect the phase angle of the input voltage quickly within a few half cycles of the input voltage and with low power loss.

According to a further embodiment of the driving method, the point in time is varied stepwise in consecutive half cycles of the input voltage to detect the phase angle of the input voltage. This reduces the control effort, since the phase angle is detected iteratively within a few half cycles of the input voltage.

As mentioned above, the present invention provides a solution to detect the phase angle of a phase cut input voltage with low technical effort by applying an electrical signal to one of the connection elements and by detecting the respective voltage dip created in the converted voltage. Therefore, the phase angle can be detected precisely and easily to drive the attached load accordingly with a high power factor and low loss.

BRIEF DESCRIPTION OF THE DRAWINGS

These and other aspects of the invention will be apparent from and elucidated with reference to the embodiment(s) described hereinafter. In the following drawings

DETAILED DESCRIPTION OF THE INVENTION

Figure 1A:
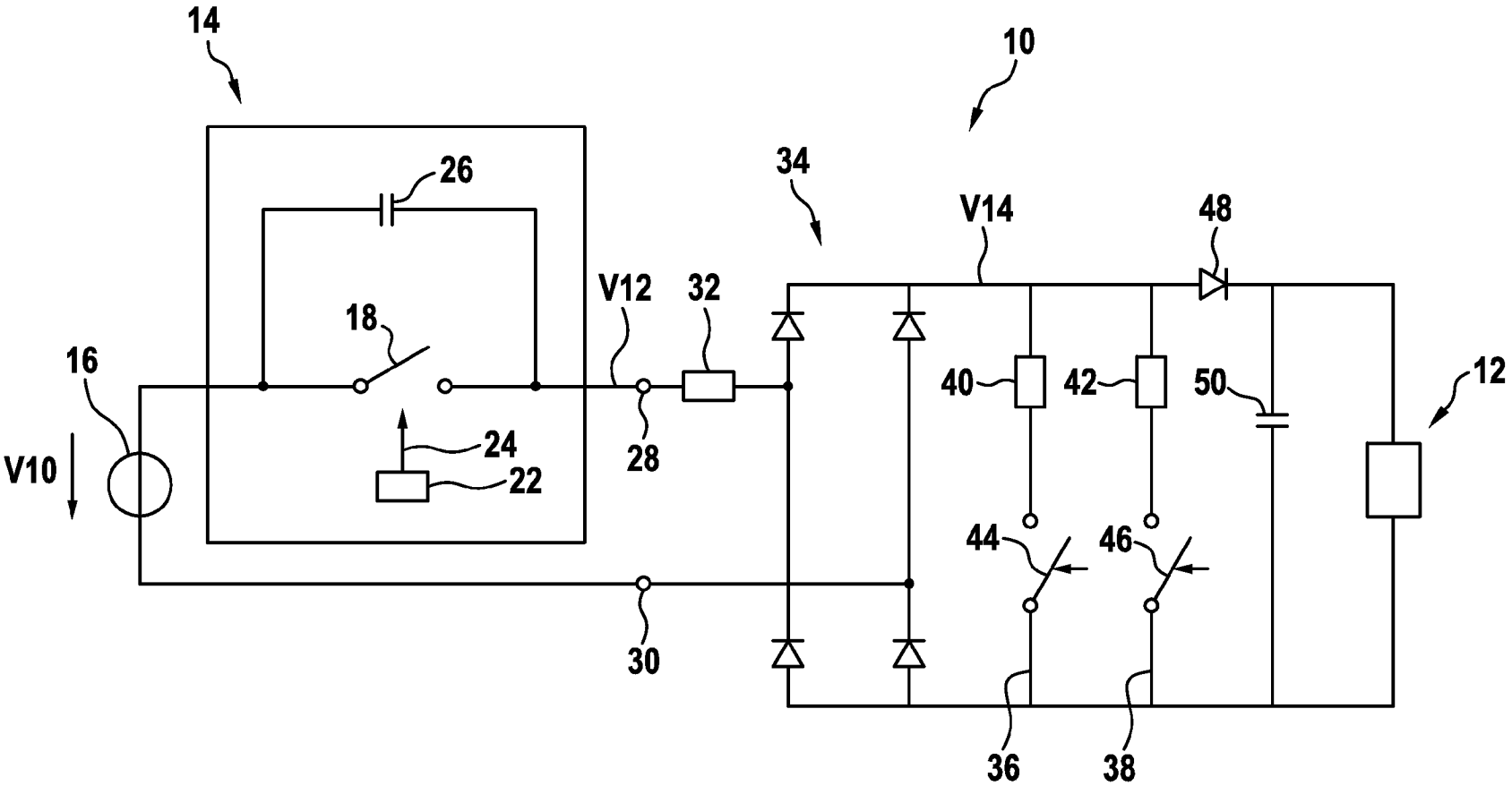
FIG. 1*a* shows a schematic block diagram of a dimmer and driver device for driving an LED unit.

An embodiment of a driver device 10 for driving a load, in particular an LED unit 12, is schematically shown in FIG. 1*a*. The driver device 10 is connected to a dimmer device 14, which is connected to an external voltage supply 16, e.g. an external mains voltage supply, and adapted for providing a phase cut AC voltage V12 from the AC supply voltage V10. The dimmer device 14 comprises a bi-directional switch 18 and a control unit 22 for controlling the switch 18. The dimmer device 14 converts the AC supply voltage V10 to a phase cut voltage V12 by switching the switch 18 and disconnecting the connection between the external voltage supply 16 and an output terminal of the dimmer device 14. The dimmer device 14 further comprises a capacitor 26 connected in parallel to the switch 18. The control unit 22 controls the switch 18 by means of a control signal 24 to provide a trailing edge phase cut signal V12.

The control unit 22 comprises a timing circuit which requires a zero crossing detection for restarting a timer at every zero crossing of the mains voltage V 10 to keep the dimmer device 14 operating properly.

The driver device 10 comprises a first input terminal 28 and a second input terminal 30 for connecting the driver device 10 to the external voltage supply 16. The first input terminal 28 is connected to the output terminal of the dimmer device 14 to receive the phase cut voltage V12. The second input terminal 30 is connected to a neutral line of the external voltage supply 16. The driver device 10 may comprise an input impedance 32 connected to the first input terminal 28. The input impedance 32 may be formed by a resistor, an inductor, an EMI-filter, or the like. The driver device 10 comprises a rectifier 34 for rectifying the phase cut voltage V12 to a rectified voltage V14. The driver device 10 further comprises a first bleeder 36 and a second bleeder 38. The bleeders 36, 38 each comprise a resistor 40, 42 and a controllable switch 44, 46. The resistors 40, 42 comprise a different resistance, wherein the first bleeder 36 comprises a large resistor 40, and wherein the second bleeder 38 comprises a small resistor 42. The bleeders 36, 38 are applied to the rectified voltage V14 by switching the switches 44, 46, wherein the second bleeder 38 is applied when a zero crossing of the supply voltage V10 is detected or the mains voltage V10 drops below 50V and wherein the first bleeder 36 is applied when the amplitude of the mains voltage drops below 200 V to reduce the power dissipation in the resistor 42. The bleeders 36, 38 connect the input terminals 28, 30 to each other during a certain time period of the phase cut voltage to adapt the driver device 10 to the dimmer device 14 so that the timing circuit of the dimmer device 14 operates as desired.

The driver device 10 further comprises a diode 48 and a capacitor 50, wherein the capacitor 50 is connected in parallel to the LED unit 12 to provide a respective drive voltage for driving the load 12. The load 12 comprises LEDs including either a linear or a switched DC/DC converter for matching the voltage of the LEDs to the voltage of the capacitor 50.

Figure 1B:
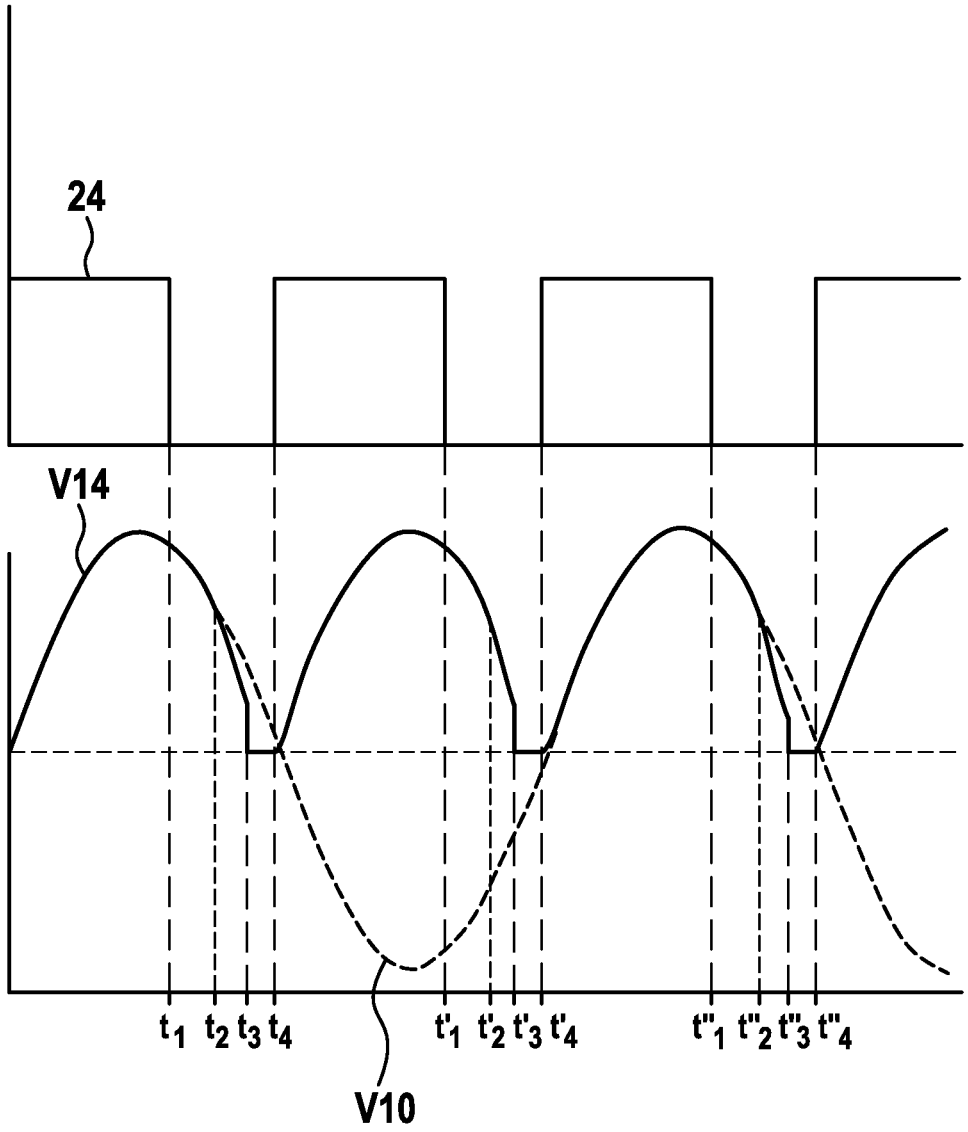
FIG. 1*b* shows a rectified voltage for driving an LED unit, a corresponding mains voltage and a control signal for driving the dimmer device.

In FIG. 1*b* a diagram is shown illustrating the voltage waveform of the rectified voltage V14, the corresponding supply voltage V10 (dashed lines) provided by the external voltage supply 16 and the control signal 24 provided by the control unit 22 for controlling the switch 18 of the dimmer device 14.

The control signal 24 switches the controllable switch 18 off and disconnects the external voltage supply 16 at t1. The rectified voltage V14 follows the supply voltage V10 until the first bleeder 36 is activated at t2. The rectified voltage V14 follows the supply voltage V10, since the input impedance of the driver device 10 is large compared to the impedance of the capacitor 26 of the dimmer device 14. Since the capacitor 26 is discharged at t1 and the voltage V10 is applied to the terminals 28,30 via the discharged capacitor 26, it is not possible to differentiate the phase cut voltage V12 and the supply voltage V10 until the first bleeder 36 is activated at t2. At t3 when the voltage V14 is decreased, e.g. below 50V, the second bleeder 38 is activated. At t4, when the zero crossing of the supply voltage V10 is detected, the control signal 24 is applied to close the controllable switch 18 again and to provide the supply voltage V10 to the output of the dimmer device 14. Both bleeders 36 and 38 are turned off at t4. The minor distortion of the rectified voltage V14 results in non-linearity and a dead zone of the dimming curve, since the phase angle of the phase cut voltage V12 cannot be detected. Compensation of this non-linearity can be overcome by applying the weak bleeder 36 earlier, however, this would increase the power dissipation of the driver device 10. Therefore, it is necessary to detect the phase angle of the phase-cut voltage to drive the LED accordingly.

Figure 2:
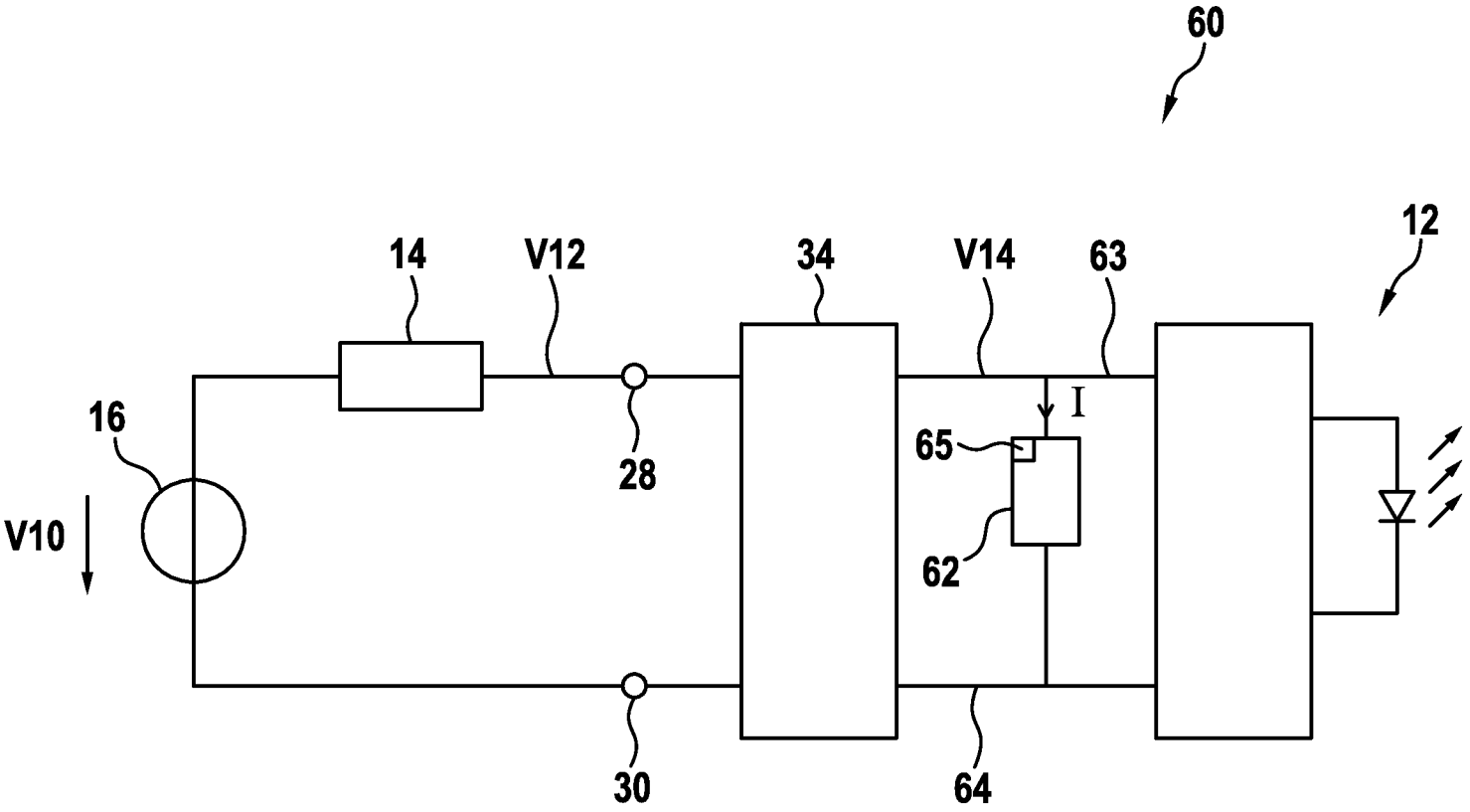
FIG. 2 shows a schematic block diagram of a driver device having a signal control unit for detecting a phase angle of the phase cut voltage provided by the dimmer device.

FIG. 2 shows a driver device 60 including a signal control unit 62 for controlling the rectified voltage V14. Main elements are identical to the elements of FIG. 1 and denoted by identical reference numerals. Here, only the differences are explained in detail.

The signal control unit 62 is connected in parallel to the rectifier 34. The rectifier 34 is connected to the load 12 by means of connection elements 63, 64. The signal control unit 62 is electrically connected to the connection elements 63, 64. The rectifier 34 provides the rectified voltage V14 to the load 12 for driving the load 12.

The signal control unit 62 is connected to the connection elements 63, 64 and provided to apply an electrical signal I to the connection elements 63, 64. The electrical signal I is an electrical current I drawn from the electrical element 63. The electrical signal I provides a voltage dip to the rectified voltage V14, which is measured by a measuring device 65 of the signal control unit 62, wherein the peak value of the voltage dip is dependent on the status of the dimmer device 14. In other words, the peak value of the voltage dip is dependent on whether a controllable switch 18 is switched on and the supply voltage V10 is provided to the rectifier 34 or the controllable switch is switched off and a capacitor 26 of the dimmer device 14 is connected to the rectifier 34. The electrical signal I is applied for a short time frame, preferably 50-100 μs, to the connection element 63. If the controllable switch 18 of the dimmer device 14 is switched on, the peak value of the voltage dip of the rectified voltage V14 is small. If the controllable switch 18 of the dimmer device is switched off, the peak value of the voltage dip is large. Therefore, the signal control unit 62 can detect the status of the dimmer device 14 and, therefore, the driver device 10 can detect the phase angle of the phase cut voltage V12 by applying the electrical signal and by measuring the peak value of the created voltage dip of the rectified voltage V14.

According to one embodiment, the signal control unit 62 comprises a current path including a low resistance to connect the connection elements 63, 64 to each other to provide the current I and to create the voltage dip of the rectified voltage V14. According to another embodiment, the signal control unit 62 comprises a controllable current source to draw the current I from the connection element 63 to the connection element 64 to create the voltage dip in the rectified voltage V14. According to a further embodiment, the signal control unit 62 comprises a charge capacitor to draw the current I from the connection element 63 and to provide the voltage dip in the rectified voltage V14 as will be described in detail in the following.

Figure 3:
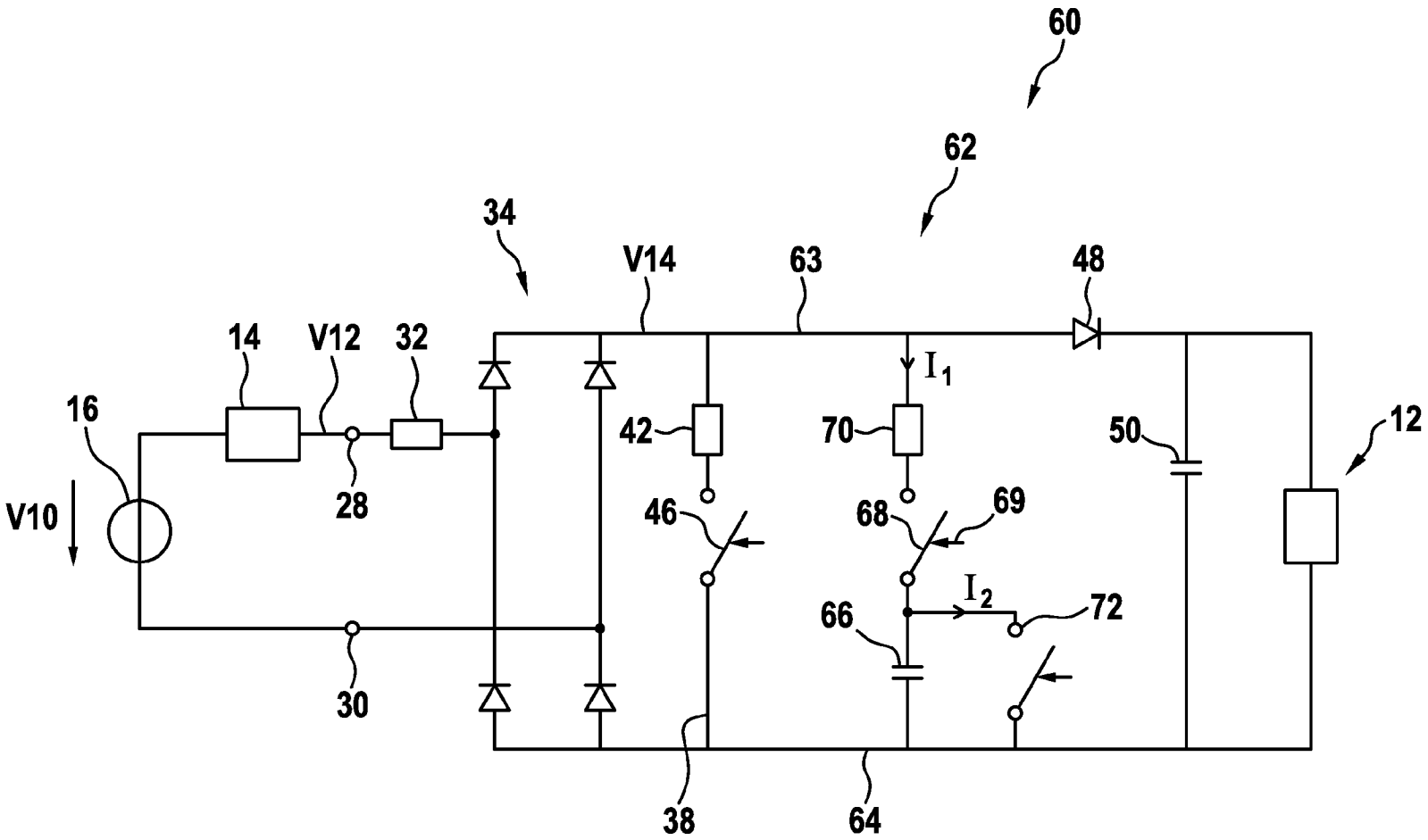
FIG. 3 shows a preferred embodiment of the driver device of FIG. 2.

FIG. 3 shows the driver device 60 including the signal control unit 62 for controlling the rectified voltage V14 according to a preferred embodiment. Identical elements are denoted by identical reference numerals, and here merely the differences are explained in detail.

The signal control unit 62 is connected to the connection elements 63, 64 in parallel to the rectifier 34. The signal control unit 62 comprises a capacitor 66, a controllable switch 68 and a resistor 70. The capacitor 66, the controllable switch 68 and the resistor 70 are connected in series to each other. A controllable switch 72 is connected in parallel to the capacitor 66. The controllable switch 72 is provided to connect terminals of the capacitor 66 to each other to discharge the capacitor 66. The controllable switch 68 is controlled by a control signal 69. During operation, the capacitor 66 is connected in parallel to the rectifier 34 by closing the controllable switch 68. When the controllable switch 68 is closed, the current I charges the capacitor 66 and the voltage dip is created in the rectified voltage V14. If the controllable switch 18 of the dimmer device 14 is switched on and the supply voltage V10 is provided to the rectifier 34, the charge current I is limited by the series resistance of the input impedance 32 and the resistor 70 of the signal control unit 62. Therefore, a limited small peak value of the voltage dip of the rectified voltage V14 is created corresponding to the voltage drop across the input impedance 32. If the controllable switch 18 is switched off, the voltage across the capacitor 66 is defined by the impedance ratio of the capacitor 26 of the dimmer device and the capacitor 66 of the signal control unit 62. If the capacity of the capacitors 26, 66 is identical (e.g. 100 nF), the rectified voltage V14 drops approximately to 50%. Therefore, a significant voltage dip of the rectified voltage V14 can be provided if the dimmer device 14 is switched off. The voltage dip of the rectified voltage V14 is measured when the controllable switch 68 is closed by means of a differentiator circuit. The differentiator circuit detects the peak value of the voltage dip and accordingly determines whether the controllable switch 18 is switched on or off.

The controllable switch 68 is preferably closed for a short time frame, e.g. 50 μs-100 μs. The controllable switch 68 and the controllable switch 72 are actuated in an alternating form such that one of the controllable switches 68, 72 is open while the other controllable switch 68, 72 is closed. Since the controllable switch 72 connects the connection elements of the capacitor 66 to each other, the capacitor 66 is discharged by means of the discharge current I2 when the controllable switch 68 is open. Therefore, it is ensured that the capacitor 66 is discharged when the controllable switch 68 is closed to draw the current I from the connection element 62.

To detect the phase angle of the phase cut voltage V12, the controllable switch 68 can be closed frequently or once per half period of the supply voltage V10. Since the power dissipation of the driver device 10 increases when the voltage dip is applied to the rectified voltage V14, the voltage dip is generated preferably only once per half period of the supply voltage V10. To detect the phase angle of the phase cut voltage V12, the point in time when the voltage dip is generated is shifted from one half period of the supply voltage V10 to the other, as described below.

Figure 4:
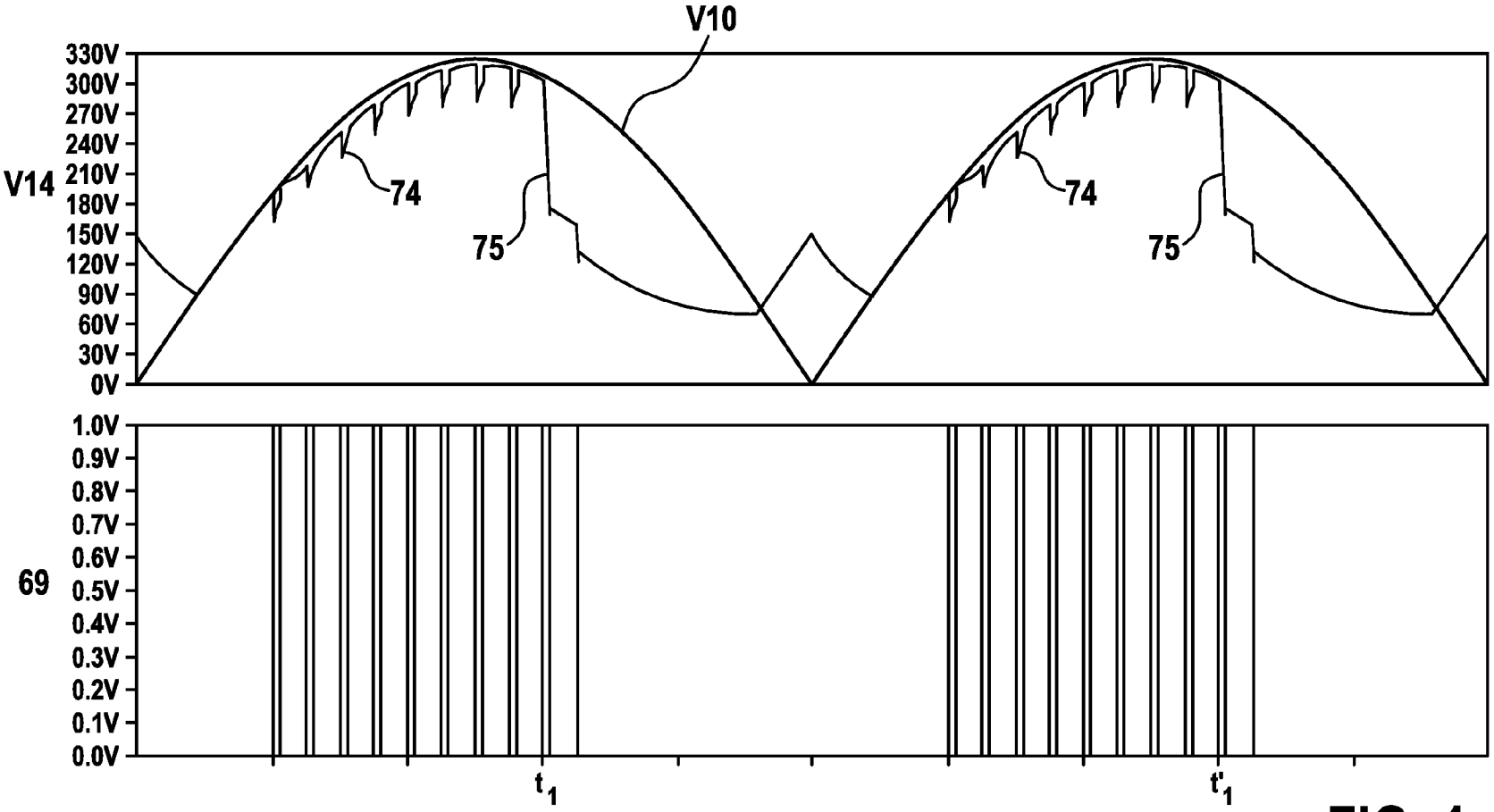
FIG. 4 shows a timing diagram of the drive voltage for driving the load provided by the driver device of FIGS. 2 and 3, a corresponding rectified mains voltage and pulsed driving signal for driving the signal control unit.

FIG. 4 shows a diagram illustrating the voltage waveform of the rectified voltage V14, the absolute value of the supply voltage V10 and the control signal 69 for controlling the controllable switch 68.

The control signal 69 for closing the controllable switch 68 is provided for several short time frames to connect the capacitor 66 to the rectifier 34 and to provide the current I. The duration of the driving pulses of the control signal 69 is less than ⅙ of the half-cycle of the input voltage V12, e.g. less than 200 μs. At each driving pulse of the control signal 69, the rectified voltage V14 shows a small voltage dip 74 during the time frame before the dimmer device 14 is switched off at t1. After the dimmer device 14 has been switched off at t1 by opening the controllable switch 18, the peak value of the voltage dip increases such that the rectified voltage V14 drops to approximately 50%. The large peak value of this large voltage dip 75 can be easily detected by means of the differentiator circuit.

Therefore, the phase angle of the phase cut voltage V12 can be easily detected by creating the voltage dip in the rectified voltage V14, and the LED unit 12 can be driven accordingly.

The energy loss per driving pulse is determined by the electrical energy stored in the capacitor 66 and depends on the voltage across the capacitor 66. The voltage across the capacitor 66 is limited by the time constant of the resistance of the resistor 70 and the capacitance of the capacitor 66. To reduce the energy loss of the driver device 10, the electrical signal I can be provided by the signal control unit 62 only once per half cycle of the supply voltage V10.

Figure 5:
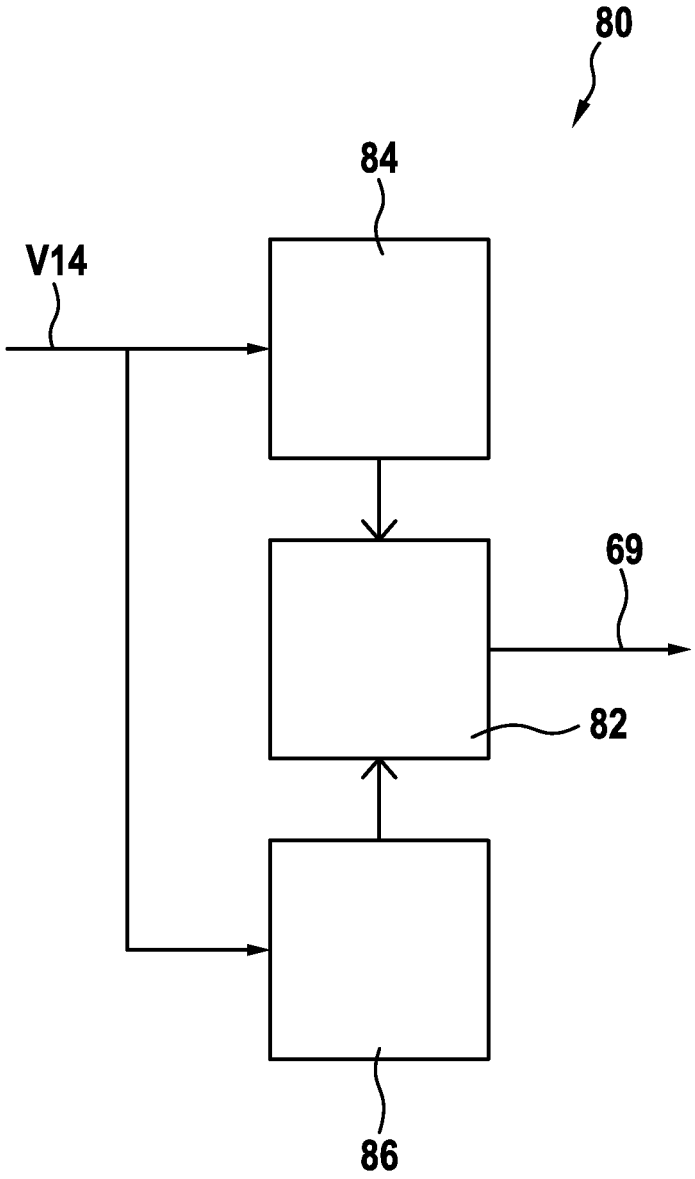
FIG. 5 shows a schematic block diagram illustrating a search unit for detecting the phase angle of the phase cut voltage provided by the dimmer device.

FIG. 5 shows a schematic block diagram of a search unit for detecting the phase angle of the phase cut voltage V12, generally denoted by 80. The search unit 80 comprises a search algorithm device 82, a zero crossing detector 84 and a differentiator 86. The zero crossing detector 84 and the differentiator 86 each measure the rectified voltage V14. The zero crossing detector 84 detects the zero crossing of the rectified voltage V14 and provides a corresponding signal to the search algorithm device 82. The differentiator 86 detects any variation of the rectified voltage V14 including the voltage dips 74, 75 created by the electrical signal I. The differentiator 86 provides information as to whether a large voltage dip 75 or a small voltage dip 74 is detected to the search algorithm device 82 by means of a control signal. The search algorithm device 82 provides the control signal 69 or in general a control signal 69 to control the signal control unit 62 and to provide the respective electrical signal I to the connection elements 63, 64. The search algorithm device 82 provides the short drive pulses to create the voltage dip 74, 75 of the rectified voltage V14. If a large voltage dip 75, i.e. a trailing edge of the phase cut voltage V12, is not detected by the differentiator 86, the search algorithm device 82 shifts the driving pulse in the following half cycle of the rectified voltage V14 to a later position to detect the phase angle of the phase cut voltage V12. If a large voltage dip 75 is detected, the search algorithm shifts the driving pulse in the following half cycle of the rectified voltage V14 to an earlier position to determine the phase angle more precisely. Therefore, the algorithm converges within 5 to 10 half cycles (with an accuracy of 3-5°) of the rectified voltage V14 to determine the phase angle precisely. The search unit 80 may be formed by an integrated digital circuit such as a microcontroller.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

A computer program may be stored/distributed on a suitable medium, such as an optical storage medium or a solid-state medium supplied together with or as part of other hardware, but may also be distributed in other forms, such as via the Internet or other wired or wireless telecommunication systems.

Any reference signs in the claims should not be construed as limiting the scope.

The invention claimed is:

1. A driver device for driving a load, in particular an LED unit comprising one or more LEDs, said driver device comprising:

input terminals for receiving an input voltage from an external power supply, wherein the input voltage is an alternating phase-cut voltage having a connected state, wherein the input voltage is applied to the input terminals, and a disconnected state, wherein the input voltage is not applied to the input terminals;

output terminals for providing an output voltage to the load for driving the load, a converter unit for converting the input voltage to a converted voltage and for providing the converted voltage to internal connection elements of the driver device, a signal control device for applying an electrical signal (I) to at least one of the connection elements, wherein the signal control device, by applying the electrical signal (I) is configured to cause a voltage dip in the converted voltage, wherein in the connected state the voltage dip comprises a first value and in the disconnected state the voltage dip comprises a second value, wherein the second value is greater than the first value; and a detection circuit configured to determine a phase angle of the input voltage by detecting when the voltage dip of the converted voltage is equal to or exceeds the second value.

2. The Driver device as claimed in claim 1, wherein the electrical signal (I) is an electrical current (I) drawn from or provided to the connection elements.

3. The driver device as claimed in claim 1, wherein the signal control device comprises an electrical storage element for storing electrical energy and a controllable switch for electrically connecting the electrical storage element to at least one of the connection elements.

4. The driver device as claimed in claim 3, wherein the electrical storage element is a charge capacitor.

5. The driver device as claimed in claim 1, wherein the signal control device further comprises a charge control element connected to the electrical storage element for controlling the electrical charge stored in the electrical storage element.

6. The driver device as claimed in claim 1, wherein the signal control device comprises a current path including a resistor and a controllable switch for connecting the connection elements to each other.

7. The driver device as claimed in claim 1, wherein the signal control Device comprises a controllable current source for providing the electrical signal (I).

8. The driver device as claimed in claim 1, wherein the converter unit comprises a rectifier unit connected to the input terminals for rectifying the input voltage to a unipolar voltage provided to the connection elements.

9. The driver device as claimed in claim 1 wherein the detection circuit comprises a differentiator circuit for measuring the voltage dip of the converted voltage.

10. The driver device as claimed in claim 1 wherein the signal control unit is adapted to provide the electrical signal (I) for a time interval less than 1/10 of a half-cycle of the input voltage.

11. The driver device as claimed in claim 1, wherein the input voltage is an alternating phase-cut voltage and wherein the signal control unit is adapted to apply the electrical signal (I) at different points in time within each half cycle of the input voltage to detect a phase angle of the input voltage.

12. A light apparatus comprising:

a light assembly comprising one or more light units, in particular an LED unit comprising one or more LEDs, and a driver device as claimed in claim 1 for driving said assembly.

13. A driving method for driving a load, in particular an LED unit comprising one or more LEDs, said method comprising:

receiving an input voltage from an external power supply at input terminals, wherein the input voltage is an alternating phase-cut voltage having a connected state, wherein the input voltage is applied to the input terminals, and a disconnected state, wherein the input voltage is not applied to the input terminals;

converting the input voltage to a converted voltage and providing the converted voltage to internal connection elements, applying an electrical signal (I) to at least one of the internal connection elements using a signal control unit wherein the signal control device, by applying the electrical signal (I) is configured to cause a voltage dip in the converted voltage, wherein in the connected state the voltage dip comprises a first value and in the disconnected state the voltage dip comprises a second value, wherein the second value is greater than the first value; and detecting a phase angle of the input voltage by detecting when the voltage dip of the converted voltage is equal to or exceeds the second value.

14. The driving method as claimed in claim 13, wherein the input voltage is an alternating phase-cut voltage and wherein the point in time at which the electrical signal (I) is applied is varied within each half cycle of the input voltage to detect the phase angle of the input voltage.

15. The driving method as claimed in claim 13, wherein the point in time is varied stepwise in consecutive half cycles of the input voltage to detect the phase angle of the input voltage.

* * * * *